US009488196B2

(12) United States Patent
Storm et al.

(10) Patent No.: US 9,488,196 B2
(45) Date of Patent: Nov. 8, 2016

(54) FLUID VALVE ARRANGEMENT COMPRISING A BISTABLE FLUID VALVE

(75) Inventors: Stefan Storm, Unterschleissheim (DE); Raphael Rammer, Munich (DE)

(73) Assignee: EADS DEUTSCHLAND GMBH, Ottobrunn (DE)

( * ) Notice: Subject to any disclaimer, the term of this patent is extended or adjusted under 35 U.S.C. 154(b) by 263 days.

(21) Appl. No.: 14/345,182

(22) PCT Filed: Aug. 13, 2012

(86) PCT No.: PCT/DE2012/100237
§ 371 (c)(1),
(2), (4) Date: Mar. 14, 2014

(87) PCT Pub. No.: WO2013/037356
PCT Pub. Date: Mar. 21, 2013

(65) Prior Publication Data

US 2014/0345267 A1 Nov. 27, 2014

(30) Foreign Application Priority Data

Sep. 15, 2011 (DE) ..... 10 2011 113 361

(51) Int. Cl.
*F15B 13/042* (2006.01)

(52) U.S. Cl.
CPC ..... *F15B 13/042* (2013.01); *F15B 2013/0428* (2013.01); *F15B 2211/329* (2013.01); *Y10T 137/7784* (2015.04); *Y10T 137/8601* (2015.04); *Y10T 137/86485* (2015.04)

(58) Field of Classification Search
CPC ..... F15B 2013/041; F15B 13/042; F15B 13/0426; F15B 2013/0428; F15B 2211/329
See application file for complete search history.

(56) References Cited

U.S. PATENT DOCUMENTS

| | | | | |
|---|---|---|---|---|
| 3,452,779 | A | 7/1969 | Klessig et al. | |
| 5,423,244 | A * | 6/1995 | Walchhutter | B30B 15/16 60/494 |
| 2005/0183770 | A1 | 8/2005 | Metzinger | |
| 2007/0044857 | A1 | 3/2007 | Rapke et al. | |

FOREIGN PATENT DOCUMENTS

| | | |
|---|---|---|
| DE | 1600815 A | 2/1970 |
| EP | 1760376 A1 | 3/2007 |
| WO | 9812406 A1 | 3/1998 |

OTHER PUBLICATIONS

Corresponding International Application No. PCT/DE2012/100237 Search Report dated Nov. 27, 2012.
Corresponding German Application No. 102011113361.9 Foreign Action dated Apr. 12, 2012.

* cited by examiner

*Primary Examiner* — Michael Leslie
(74) *Attorney, Agent, or Firm* — Hauptman Ham, LLP

(57) ABSTRACT

The invention relates to a fluid valve arrangement having a bistable fluid valve for at least one fluid line with a valve body which can be moved into two positions for two switching states, a pressure pulse generator being provided for valve switchover in the feed line for switching over a feed line and a return line between two flow lines, and the fluid valve comprising a reversing unit which has two chambers which are separated from one another by a bistable surface element, the two chambers being connected to the two flow lines and the bistable surface element being operatively coupled to the valve body in order to actuate it. As a result, a bistable fluid valve is provided which can be reversed by way of pressure pulses or pressure flanks and otherwise has no energy requirement.

6 Claims, 2 Drawing Sheets

FLUID VALVE ARRANGEMENT COMPRISING A BISTABLE FLUID VALVE

RELATED APPLICATIONS

Figure 1:
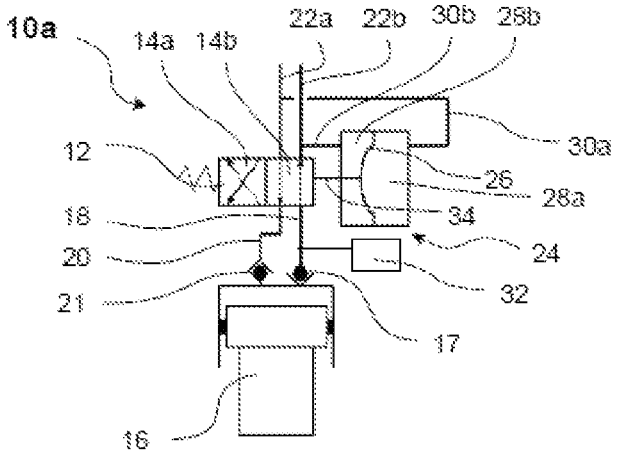

The present application is National Phase of International Application Number PCT/DE2012/100237 filed Aug. 13, 2012 and claims priority to German Application Number 10 2011 113 361.9 filed Sep. 15, 2011.

The invention relates to a fluid valve arrangement having a bistable fluid valve for at least one fluid line with a valve body which can be moved into two positions for two switching states.

Directional or shut-off valves are used in most hydraulic systems, in order to reverse or to interrupt the fluid volumetric flow. A dedicated actuator system, power supply and control electronics are necessary to control the valve. If rapidly switching valves are required for high actuating frequencies, high electrical losses are necessarily produced to control the valve.

Proceeding from this, the invention is based on the object of providing a bistable fluid valve which can be reversed by way of pressure pulses or pressure flanks and otherwise has no energy requirement.

The invention results from the features of the independent claims. Advantageous developments and refinements are the subject matter of the dependent claims. Further features, possible uses and advantages of the invention result from the following description and the explanation of exemplary embodiments of the invention which are shown in the figures.

The above object is achieved according to Claim 1 by virtue of the fact that a pressure pulse generator is provided for valve switchover in the feed line for switching over a fluid feed line and a fluid return line between two flow lines, and the fluid valve comprises a reversing unit which has two chambers which are separated from one another by a bistable surface element, the two chambers being connected to the two flow lines and the bistable surface element being operatively coupled to the valve body in order to actuate it. The bistable surface element has the property of being able to assume two shapes which are different from one another. A force is necessary for the change from one shape into the other shape. In the present case, the bistable surface element is loaded with pressure from one side or from both sides. The pressure difference between the two sides brings about the change from one shape into the other shape given a sufficient magnitude.

By way of the pressure pulse generator in the fluid feed line, the pressure pulse is transmitted to a first of the two chambers in the reversing unit independently of the valve position via that one of the two flow lines which is connected to the feed line. The pressure pulse generator can be configured either as a separate pressure pulse transmitter or can be realized by a connected piston pump. Since the second chamber communicates with the pressureless return line, the pressure pulse leads to the bistable surface element snapping out of the first position into a second position and therefore moving the valve body into the second position, in which the two flow lines are then reversed with respect to the feed line and the return line, that is to say the flow line which was previously connected to the return line now communicates with the feed line and vice versa. For example, a hydraulic motor which is connected to the flow lines can be reversed in this way. In order to bring about switching of the valve back into the starting position, a further pressure pulse is generated by means of the pressure pulse transmitter, which further pressure pulse then loads the second chamber in the reversing unit on account of the reversed valve via the second flow line, at the same time the first chamber communicating with the pressureless flow line and, as a result, the bistable surface element snapping back into the original position.

It is essential here that the bistable surface element is pushed by a pressure pulse in the current outlet line into the other stable position. Here, the bistable element has to withstand the maximum pressure difference which can be built up in the stable positions, without reversing. The pressure pulse for reversing has to exceed the maximum pressure difference which occurs during operation between the outlet and inlet lines.

Furthermore, the above object is achieved according to Claim 2 by virtue of the fact that a pressure pulse transmitter is provided for valve switchover in the fluid line and the fluid valve comprises a reversing unit which has two chambers which are separated from one another by a bistable surface element, one of the chambers communicating directly with the fluid line, whereas the other chamber is connected via a pressure changing member to the fluid line and the bistable surface element is operatively connected to the valve body in order to actuate it. In this embodiment, both chambers are therefore connected to the same fluid line and the switchover of the valve takes place on account of the pressure flanks which occur in the fluid line. This embodiment is therefore suitable, in particular, for coupling to piston pumps or piezopumps. A pressure difference between the two chambers which bring about a switchover of the valve is produced by way of a rising pressure flank which acts directly on one chamber whereas it does not act in the same way on the second chamber via the pressure changing member.

According to a first preferred development, the pressure changing member is a throttle which brings about a time-delayed action of the pressure on the associated chamber. A switchover is therefore brought about by way of a rising pressure flank and a switch back into the starting position is brought about by way of a falling pressure flank, because the pressure drop, just like the pressure rise, acts on one chamber directly and on the second chamber only in a delayed manner. The pressure changing member can therefore be tuned in such a way that the switchover by way of a modified pressure flank profile is controlled directly by the fluid pump. A pulsing pressure profile is produced at the pump outlet side in the case of coupling to a piston pump. The bistable surface element is switched to and fro by way of steep pressure rise or fall flanks of the pump outlet pressure, the throttle generating the pressure difference which is necessary for this purpose.

According to a second preferred development, the fluid valve is coupled to a fluid pump which operates in a pulsed manner, and one chamber of the reversing unit is connected directly to the fluid line and the other chamber is connected via a resonance tube to the fluid line, the resonance tube being tuned to the frequency of the fluid pump. In this embodiment, the fluid valve first of all remains in the starting position in the case of coupling to the fluid pump (piston pump or piezopump). If the pump is stopped briefly, the fluid column in the resonance tube oscillates further and loads the chamber which is coupled to it and therefore the bistable surface element and therefore switches the fluid valve into the second position.

According to one advantageous development of the invention, the bistable surface element is configured in the form of a spherical cap. In this way, a round arrangement is possible which is structurally simple, can be sealed easily and makes snapping over with hysteresis possible.

Further advantages, features and details result from the following description, in which at least one exemplary embodiment is described in detail, possibly with reference to the drawing. Identical, similar and/or functionally identical parts are provided with identical reference numerals.

Figure 2:
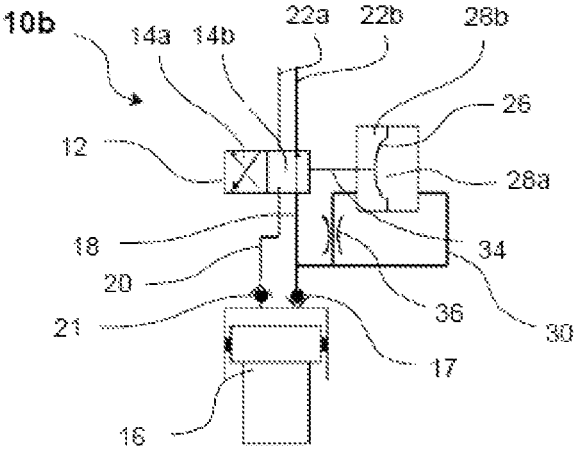
Figure 3:
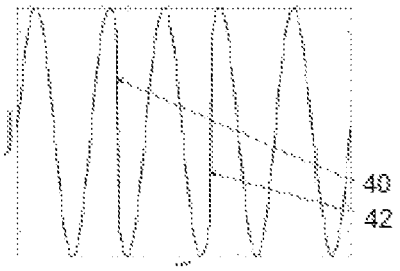
Figure 4:
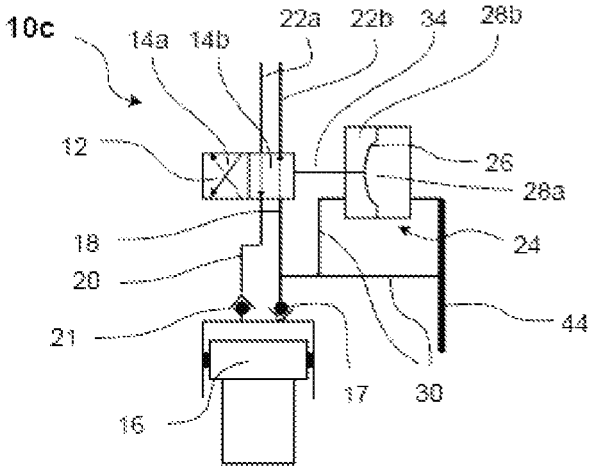
Figure 5:
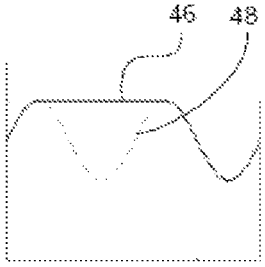

In the drawing:

FIG. 1 shows a diagrammatic illustration of a first embodiment of a fluid valve, FIG. 2 shows a diagrammatic illustration of a second embodiment of a fluid valve, FIG. 3 shows a pressure profile diagram with respect to the embodiment according to FIG. 2, FIG. 4 shows a diagrammatic illustration of a third embodiment of a fluid valve, and FIG. 5 shows a pressure profile diagram with respect to the embodiment according to FIG. 4.

The first embodiment (shown diagrammatically in FIG. 1) of a fluid valve 10*a* substantially comprises a valve body 12 which has two valve body sections 14*a*, 14*b* which bring about reversing of the fluid flow which flows from a fluid pump 16 via a non-return valve 17 and a fluid feed line 18 and back again via a fluid return line 20 and a further non-return valve 21. Accordingly, the fluid flow through the two flow lines 22*a*, 22*b* will take place either in one direction or in the other direction which is opposite with respect thereto.

The fluid valve 10*a* comprises a reversing unit 24 which consists substantially of two chambers 28*a*, 28*b* which are separated from one another in a pressure-tight manner via a bistable surface element 26, preferably with the shape of a spherical cap. The two chambers 28*a*, 28*b* are connected via connecting lines 30*a*, 30*b* to the flow lines 22*a*, 22*b*.

A pressure pulse transmitter 32 which imparts a pressure pulse to the fluid feed line 18 is arranged in the fluid feed line 18. As an alternative to this, the pressure pulse can also be generated directly via the fluid pump if its design permits this. Proceeding from the position which is shown in FIG. 1, the pressure pulse which is generated by the pressure pulse transmitter 32 is transmitted via the fluid feed line 18, the valve body 12, the flow line 22*b*, the connecting lines 30*b* to the chamber 28*b*. Since the other chamber 28*a* does not experience the pressure pulse, the pressure difference over the surface element 26 rises, which leads to said surface element 26 snapping out of the position which is shown in FIG. 1 into a second stable position, in which the surface element 26 is folded over to the right. Via a connecting rod 34 which is fastened both to the surface element 26 and to the valve body 12, the latter is displaced into a second position, in which the flow paths are then reversed, that is to say the fluid feed line 18 is then connected to the flow line 22*a* and the fluid return line 20 is connected to the flow line 22*b*. In order to achieve switching back of the fluid valve 12, a pressure pulse is again transmitted from the pressure pulse transmitter 32 via the fluid feed line 18, the valve body 12, the flow line 22*a*, the connecting lines 30*a* to the chamber 28*a*. Since the chamber 28*b* does not experience the pressure pulse, the valve body 12 snaps back into the position which is shown in FIG. 1.

FIG. 2 diagrammatically shows a second embodiment of a fluid valve 10*b*. Identical components have the same reference numerals as in FIG. 1. The fluid valve 10*b* differs from the above-described fluid valve in that both chambers 28*a*, 28*b* are connected to the fluid feed line 18, to be precise one chamber 28*a* is connected directly via the connecting line 30, with the result that pressure changes in the feed line 18 act directly in the chamber 28*a*, and the other chamber 28*b* is connected via a throttle 36, with the result that pressure pulses in the feed line 18 arrive in the chamber 28*b* only with a time delay. In this embodiment, a switchover of the valve body 12 takes place at every pressure flank in the feed line 18. By way of suitable tuning of the pressure changing element, the switchover can also take place on account of modified pressure flanks by the fluid pump. This is shown in FIG. 3 as an exemplary pressure profile in the feed line 18 if a reciprocating piston pump 16 is used. If, starting from the position which is shown in FIG. 2, the falling pressure flank which is denoted by 40 in FIG. 3 occurs on the feed line 18, the falling pressure acts directly in the chamber 28*a* which is connected directly to it. In contrast, the pressure in the chamber 28*b* which is connected via the throttle 36 falls with a time delay, with the result that a pressure difference is built up which at some point brings about snapping over of the surface element 26. As a result, the valve body 12 is once again displaced via the connecting rod into the second position. In the reverse case, a rising pressure flank which is denoted by 42 in FIG. 3 leads to a direct pressure rise in the chamber 28*a* and to a time-delayed pressure rise in the chamber 28*b*, with the result that the surface element snaps back and moves the valve body 12 back into the position which is shown in FIG. 2 again.

FIG. 4 diagrammatically shows a third embodiment of a fluid valve 10*c*. Identical components have the same reference numerals as in FIGS. 1 and 2. As in the embodiment of FIG. 2, in the case of the fluid valve 10*c*, one chamber 28*b* is connected via the connecting line 30 to the feed line 18, whereas the other chamber 28*b* is connected via a resonance tube 44 to the feed line 18, the resonance tube being set to a resonant frequency which corresponds to the pulsing frequency of the fluid pump 16. During operation at the pulsing frequency, the fluid valve first of all remains in the position which is shown. If the fluid pump 16 is then stopped briefly, the pressure which is shown in FIG. 5 by means of line 46 remains high, while the resonance tube 44 continues to oscillate with the consequence that the pressure in the connected chamber 28*a* continues to oscillate, as is shown by the dashed line 48. Since the pressure likewise remains high in the directly connected chamber 28*b*, the result is a pressure difference in the two chambers 28*a*, 28*b*, which pressure difference leads to snapping over of the surface element 26.

If fluid is mentioned in conjunction with the invention, every largely incompressible fluid is meant, preferably hydraulic fluid.

LIST OF REFERENCE NUMERALS

10*a, b, c* Fluid valve
12 Valve body
14*a, b* Valve body section
16 Fluid pump
18 Fluid feed line
20 Fluid return line
22*a, b* Flow line
24 Reversing unit
26 Surface element
28*a, b* Chamber
30*a, b* Connecting line
31 Pressure pulse transmitter
34 Connecting rod
36 Throttle
40 Falling pressure flank
42 Rising pressure flank

44 Resonance tube
46 Pressure profile, pump
48 Pressure profile, resonance tube

The invention claimed is:

1. Fluid valve arrangement having a bistable fluid valve for a fluid feed line and a fluid return line with a valve body which can be moved into two positions for two switching states, characterized in that a pressure pulse generator is provided for valve switchover in the feed line for switching over the fluid feed line and the fluid return line between two flow lines, and the fluid valve comprises a reversing unit which has two chambers which are separated from one another by a bistable surface element, the two chambers being connected to the two flow lines and the bistable surface element being operatively coupled to the valve body in order to actuate it.

2. Fluid valve arrangement according to claim 1, characterized in that the pressure pulse generator is formed by a reciprocating piston pump which is connected to the fluid valve arrangement.

3. Fluid valve arrangement according to claim 1, characterized in that the bistable surface element is configured in the form of a spherical cap.

4. Fluid valve arrangement having a bistable fluid valve for at least one fluid line with a valve body which can be moved into two positions for two switching states, characterized in that the fluid valve comprises a reversing unit which has two chambers which are separated from one another by a bistable surface element], one of the chambers communicating directly with the fluid line, whereas the other chamber is connected via a pressure changing member to the fluid line and the bistable surface element is operatively coupled to the valve body in order to actuate it.

5. Fluid valve arrangement according to claim 4, characterized in that the pressure changing member is a throttle point.

6. Fluid valve arrangement according to claim 4, characterized in that it is coupled to a fluid pump which operates in a pulsed manner, and one chamber is connected directly to the fluid line and the other chamber is connected via a resonance tube to the fluid line, the resonance tube being tuned to the frequency of the fluid pump.

* * * * *